US007658298B2

(12) United States Patent
Merey

(10) Patent No.: US 7,658,298 B2
(45) Date of Patent: Feb. 9, 2010

(54) FOOD CONTAINER

(76) Inventor: Thomas G. B. Merey, c/o D.S.M. International Services Ltd., 5986 Chome Rd., R.R. H4, Port Hope, Ontario (CA) L1A 3V8

( * ) Notice: Subject to any disclaimer, the term of this patent is extended or adjusted under 35 U.S.C. 154(b) by 189 days.

(21) Appl. No.: 11/783,552

(22) Filed: Apr. 10, 2007

(65) Prior Publication Data

US 2007/0235457 A1 Oct. 11, 2007

(30) Foreign Application Priority Data

Apr. 11, 2006 (CA) ..... 2,542,567

(51) Int. Cl.
*B65D 25/04* (2006.01)

(52) U.S. Cl. ..... 220/522

(58) Field of Classification Search ..... 220/502, 220/521, 522; 206/219, 221; 215/6, DIG. 8
See application file for complete search history.

(56) References Cited

U.S. PATENT DOCUMENTS

| | | | | |
|---|---|---|---|---|
| 3,732,909 | A * | 5/1973 | Rooke et al. | 220/792 |
| 4,264,007 | A * | 4/1981 | Hunt | 206/219 |
| 6,302,268 | B1 * | 10/2001 | Michaeli | 206/221 |
| 2006/0191805 | A1 * | 8/2006 | Vogel et al. | 206/222 |

* cited by examiner

*Primary Examiner*—Harry A Grosso

(57) ABSTRACT

The container has a bowl and lid which together define a hollow enclosure. A reservoir projects downwardly into the enclosure from the lid. The reservoir has an opening which is closed by a cap which, when closed, prevents the contents of the reservoir from discharging into the bowl. A lever is attached to the cap and is in contact with the brim of the opening. The brim acts as a fulcrum about which the lever pivots. A catch causes the lever to pivot with resulting opening of the cap and discharging of the contents of the reservoir into the enclosure. The catch extends through an opening in the lid so that it can be operated from outside the container.

13 Claims, 6 Drawing Sheets

FOOD CONTAINER

BACKGROUND OF THE INVENTION

This invention relates to containers for food and more particularly to a container for portions of food such as a salad. The container has a reservoir for a sauce such as salad dressing and has means for selectively opening the reservoir in order to discharge the sauces into the interior of the container where it mixes with the food portions.

Small portable containers intended specifically for such foods as salads are well known, Such containers contain a bowl which is relatively large for the salad and a relatively small compartment below the bowl for a salad dressing. There is provision for opening the compartment from outside the container, usually by applying downward pressure on a portion of the outer wall of the container. When the compartment is opened, the salad dressing spills into the salad below and the two can be mixed together by shaking the container. By keeping the salad and the salad dressing apart until immediately prior to serving, the salad remains fresh, dry and free of sogginess An example of such a container is described in U.S. Pat. No. 6,302,268 B1 to Michaeli. In that patent, the upper wall of the compartment containing the dressing is flexible and when it is pressed downward, a pin beneath the wall is forced downward. The pin is attached to a cap which opens and closes an outlet at the bottom of the compartment. When the cap is forced downward, it opens the compartment and allows the dressing to spill into the salad below.

Many such containers such as that described in the Michaeli have a number of short-comings. The compartments for salad dressing of such containers project outwardly of the container and if the compartments are accidentally pressed or squeezed, they will spring open with resulting spillage of the dressing onto the salad in the bowls below. A salad becomes soggy and unappetizing if the dressing remains in contact with it for too long.

Another shortcoming of many such containers is that the outlets in the salad-dressing compartments through which the dressing flows are too restricted and much of the dressing remains in the compartment after it is open. This is a particular problem where the dressing is viscous such as those containing particles of cheese and those containing thick cream.

SUMMARY OF THE INVENTION

The container of the subject invention overcomes many of the shortcomings of conventional containers such as those described above. Briefly the container of the subject invention comprises: a bowl having an upwardly facing opening and a lid removably attached to the bowl for covering the opening. The bowl and the lid together define a hollow enclosure. A reservoir is associated with the lid and projects into the enclosure. The reservoir has an outlet which opens into the bowl; a cap for opening and closing the outlet; and a catch having a handle disposed outside the container. The catch is operable by drawing its handle away from the container to cause the cap to open with resulting discharge of the contents of the reservoir into the enclosure.

DESCRIPTION OF THE DRAWINGS

The container of the invention is described with reference to the accompanying drawings in which.

Like reference characters refer to like parts throughout the description of the drawings.

DESCRIPTION OF PREFERRED EMBODIMENT

Figure 1:
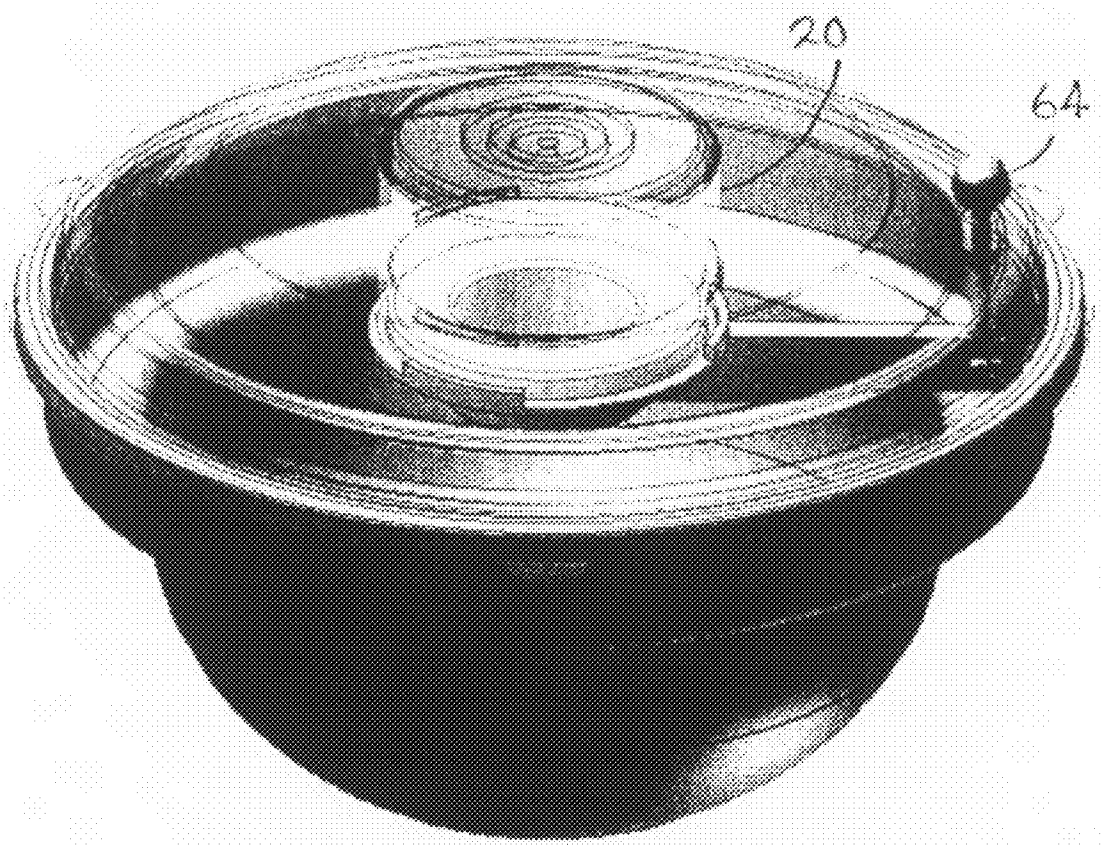
FIG. 1 is a perspective view of the container showing a reservoir and other components in its interior through a transparent lid.
Figure 1A:
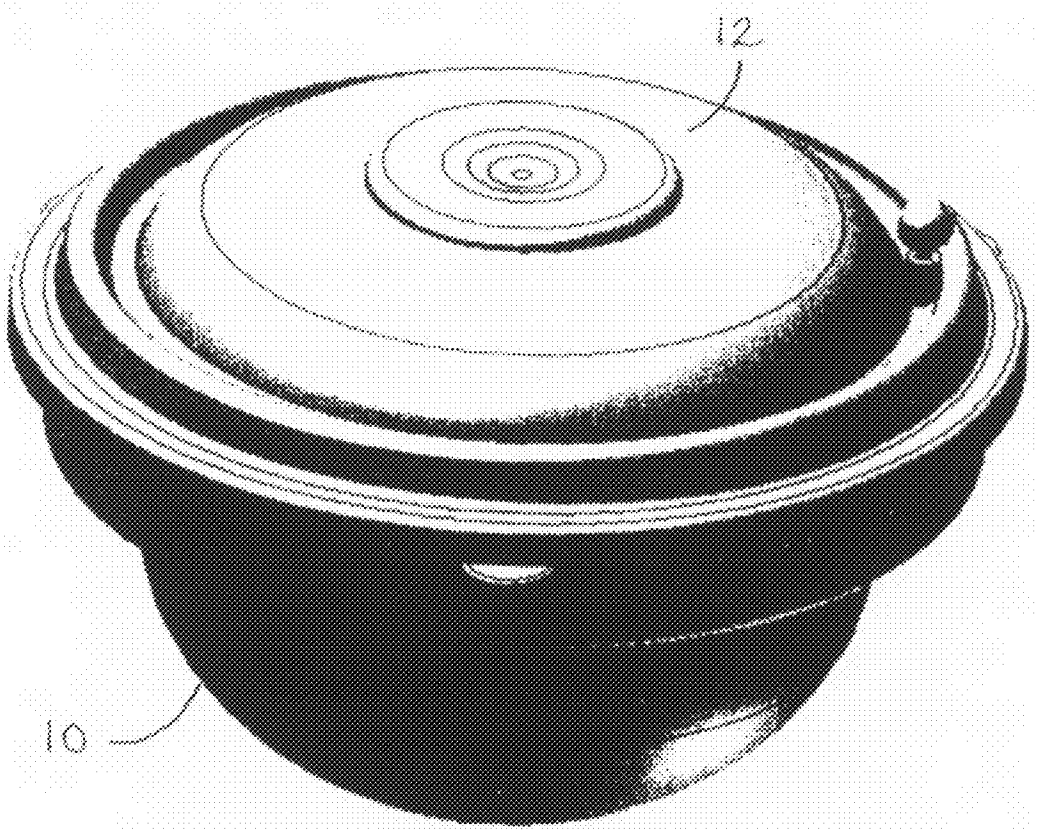
FIG. 1A is a perspective view of the exterior wall of the container.
Figure 2:
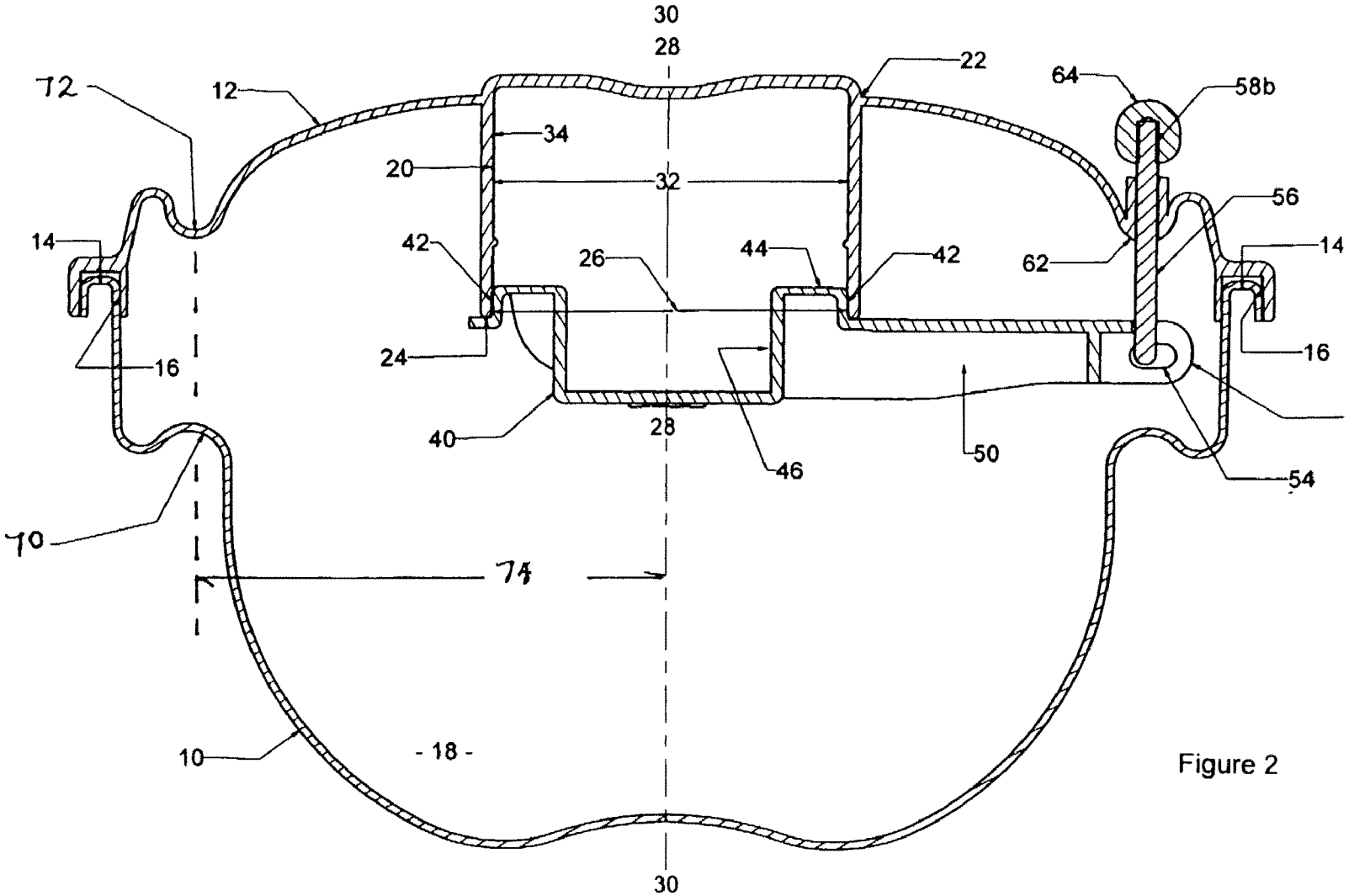
FIG. 2 is a cross-section of the container, in larger scale.

With reference to FIGS. 1, 1A and 2, the container of the invention includes a bowl 10 and a lid 12. The bowl has an upwardly facing opening defined by a circular rim 14 and the lid has an annular downwardly facing channel or socket 16 within which the rim is removably received when the container is closed.

When the container is closed, the bowl and lid define a hollow enclosure, generally 18 for relatively small portions or pieces of such food as lettuce, carrots, meat and the like.

The bowl and lid are composed of resiliently deformable material such as plastic so that the rim snaps into the socket in order to attach the rim to the bowl. Conversely, the rim snaps out of the socket in order to separate the lid from the bowl.

A reservoir 20 is integrally moulded with the lid or is friction-fit into an aperture 22 in the lid. The reservoir extends downwardly into the interior of the container and terminates at a lower brim 24 which defines an outlet 26. The reservoir is in the shape of a cylinder and has a vertical axis 28-28 which coincides with the vertical axis 30-30 of the container. The diameter 32 of the cylindrical interior wall 34 of the reservoir is substantially the same as the diameter of outlet 26.

Figure 3:
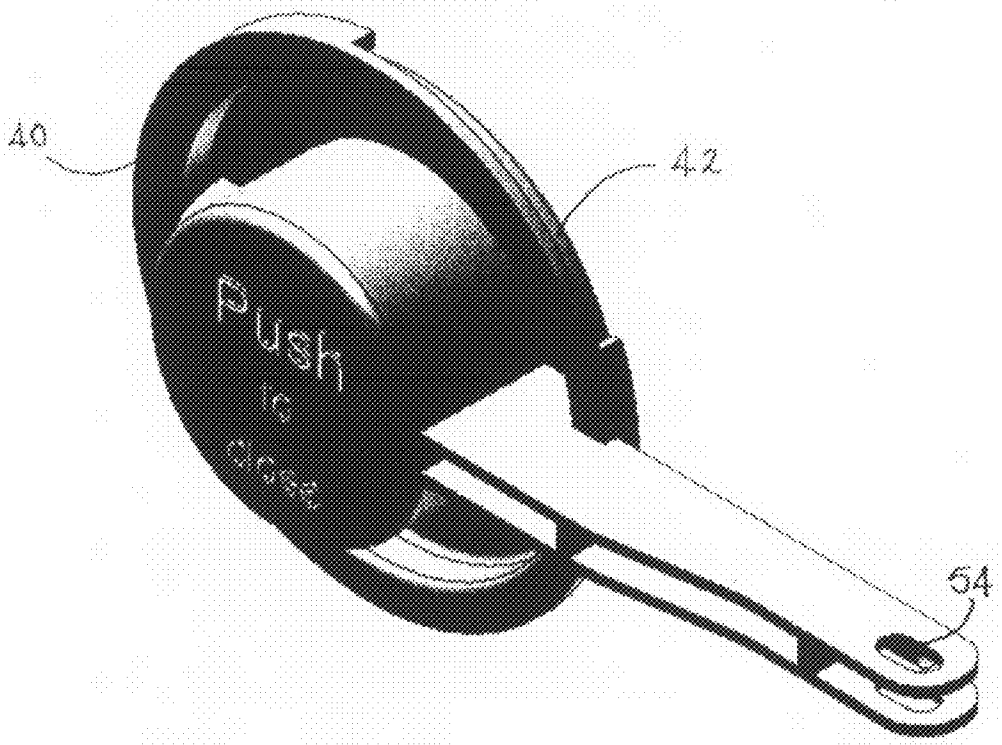
FIG. 3 is a perspective view of a cap, in larger scale.
Figure 4:
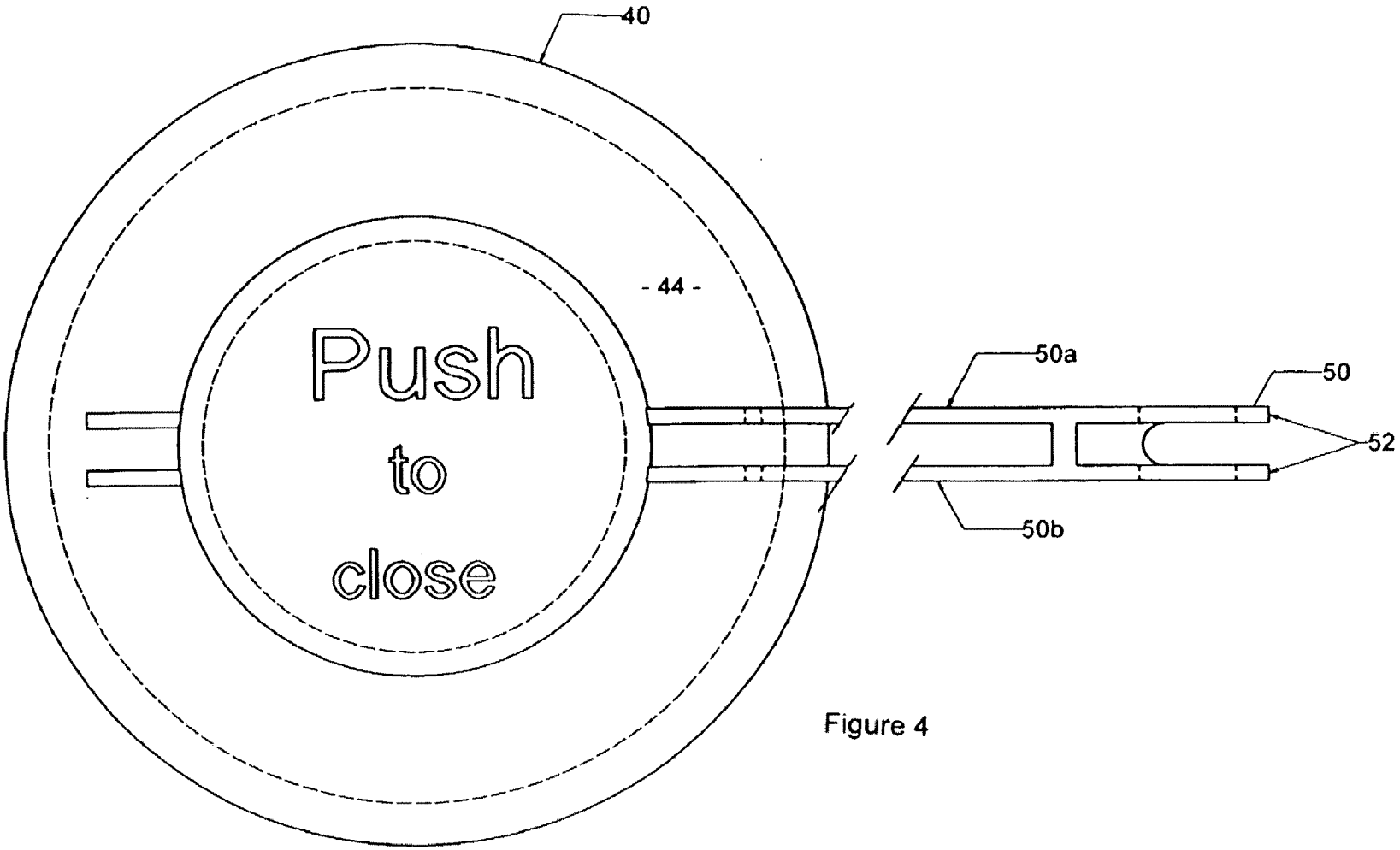
FIG. 4 is a plan view of the cap from its bottom, in larger scale.

With reference to FIGS. 2, 3 and 4, a cap 40 is removably attached to the reservoir at its outlet 26. The cap has a slightly bevelled annular surface 42 at its upper end. The bevelled surface functions to frictionally engage the interior wall 34 of the reservoir. When so engaged, the cap acts to close the reservoir.

The uppermost wall 44 of the cap extends cross-axially inward from the bevelled surface and terminates at a downwardly extending cylindrical compartment 46. Compartment 46 traps air and functions to facilitate removal of the cap. The way it does so is explained below.

A lever 50 is attached to the lower wall of the cap. The lever is composed of two identical parallel plates 50*a,b* which are spaced apart from each other by a small distance. The plates extend radially outwardly and terminate short of the outer wall of the bowl at an outer end 52. An eyelet 54 is formed in each plate adjacent to its outer end. The eyelet receives a catch 56.

Figure 5:
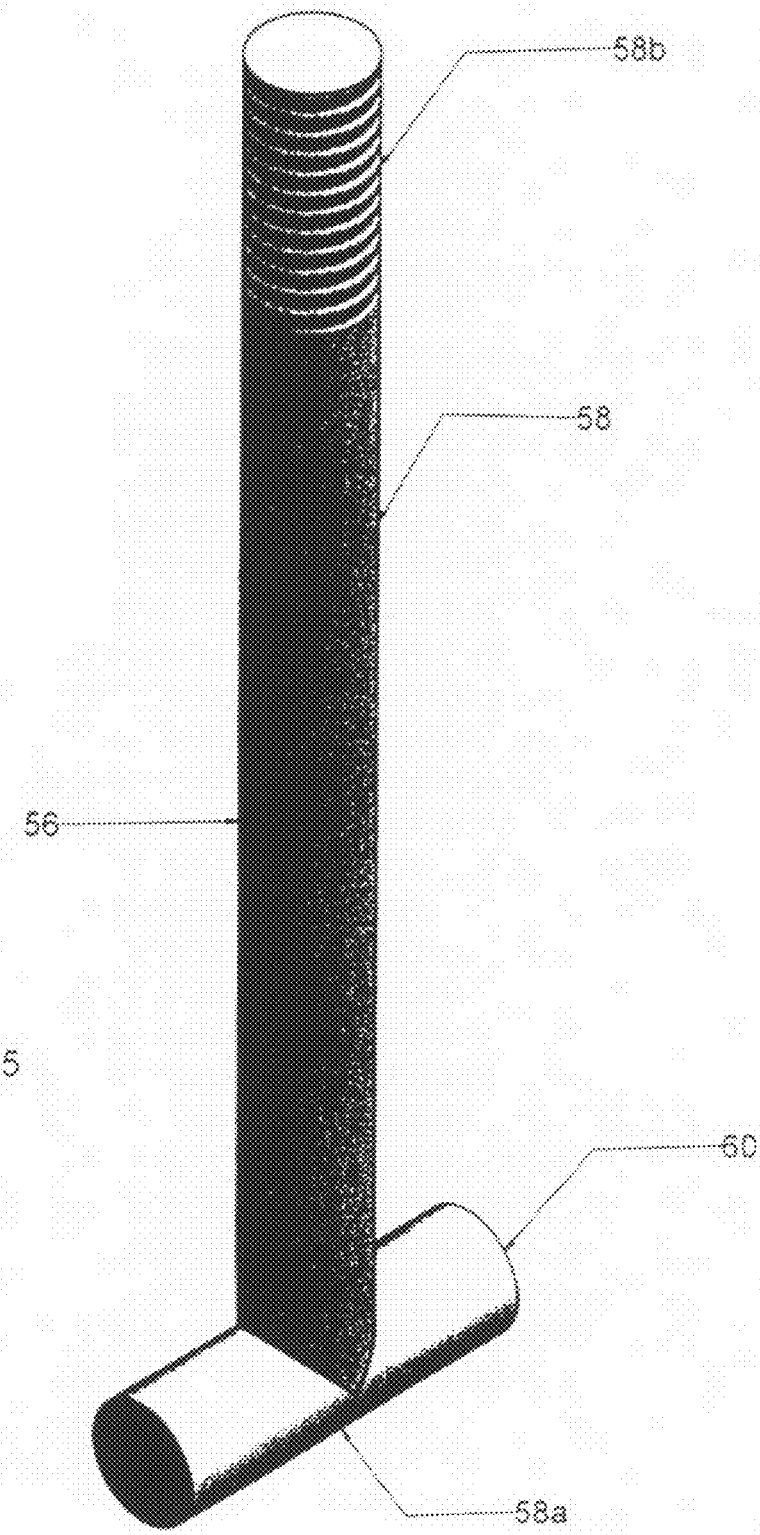
FIG. 5 is a perspective view of a catch for operating the cap; in larger scale than in any other drawing.

With reference to FIGS. 2 and 5, the catch is T-shaped and is composed of an elongated vertical rod 58 having a lower end 58*a* to which a short bar 60 is attached. The point of attachment of the bar to the rod is approximately midway of the length of the bar and the axes of the rod and bar are normal to each other.

The catch is attached to the lever by placing the rod between the two plates such that the longitudinal axis of the bar is parallel to the faces of the plates. The rod is then rotated 90 degrees thereby forcing the plates apart sufficiently to allow each end of the bar to enter a separate eyelet 54. The lever is composed of resiliently deformable material to allow the plates to be forced apart in this manner.

The lower end of the catch is attached to the lever in the interior of the container. The rod extends upwardly through an aperture 62 in the lid and terminates at a threaded upper end 58*b* which is outside the container. A knob 64 is threadably attached to the upper end and the knob and rod function as a handle which can be grasped from outside the container.

Since the reservoir, cap, lever and catch are all attached, either directly or indirectly, to the lid of the container, they do not interfere with the attachment or removal of the lid from the container.

With reference again to FIG. 2, the bowl is provided with an annular shoulder or groove 70 on its side wall. The lid is also provided with an annular groove 72 on its upper wall. The two grooves 70, 72 are vertically spaced apart from one another and both grooves are spaced an equal distance from axis 30 of the container. The distance is marked 74 in FIG. 2. The grooves facilitate grasping of the container when it is being shaken.

The container is suitable for use where it is desired to store or to carry a quantity of relatively small portions of food such as a salad and to add a sauce such as a salad dressing to the food immediately before it is consumed but not before. The small portions of food are placed in the bowl while the bowl is upright. The sauce is poured into the reservoir while the cap is removed from the reservoir and the lid is upside down and removed from the bowl. The cap is then pressed over the outlet of the reservoir to hold it in place and the lid is attached to the container by pressing the lid over the top of the bowl.

Compartment 46 traps air and facilitates the removal of the cap by means of knob or handle 64. As indicated above, filling of the reservoir involves removing the lid from the bowl, turning the lid upside down and filling the reservoir. The reservoir is full when the sauce reaches brim 24 of the reservoir. The cap is then closed to confine the sauce within the reservoir. When the cap is closed, air within compartment 46 is trapped in the reservoir since the compartment is above the reservoir at this time.

In the absence of the trapped air, a vacuum may develop in the reservoir, particularly if the container is shaken vigorously. Such vacuum will resist removal of the cap and if the handle has to be pulled hard to overcome the vacuum, either the lever or catch or both may fracture.

The air trapped in compartment 46 functions to relieve that pressure and will accordingly make it possible to remove the cap without difficulty no matter how much sauce was poured into the reservoir.

Immediately before the food is to be consumed, the handle of the catch is manually grasped and is pulled upward and away from the container. As the knob is pulled, the catch causes the outer ends of the two plates which make up the lever to pivot upward toward the lid. The inner end of the lever is in contact with the brim 24 of the outlet of the reservoir. The brim acts as a fulcrum about which the lever pivots so that as the outer end of the lever moves upward, the inner end of the lever to which cap 40 is connected pivots downward with resulting opening of the outlet. The sauce within the reservoir then spills into the food portions within the bowl.

The container is then manually grasped by inserting the thumb and fingers into grooves 70, 72 and the container is then shaken to distribute the sauce throughout the food portions. The loosened cap flops in the food portions as the container is shaken and aids in the mixing of the sauce and the food portions.

It will be understood that only by pulling the catch away from the container will the reservoir containing the sauce be opened. It will not be opened if the container or the reservoir is pushed downward or is squeezed. It is highly unlikely that the catch will be pulled outward unintentionally and accordingly accidental mixing of the sauce with the food portions in the container is highly unlikely. By contrast, sauces in reservoirs which are opened by downward pressure on the reservoir are more likely to be mixed with food portions since pushing or squeezing of such containers can accidentally occur.

It will also be understood that modifications can be made in the structure of the container as described herein without departing from the scope and purview of the invention as claimed in the appended claims.

I claim:

1. A container for a number of portions of food comprising: a bowl having an upwardly facing opening; a lid removably attached to said bowl for covering said opening, said bowl and said lid together defining a hollow enclosure; a reservoir associated with said lid and projecting into said enclosure, said reservoir having an outlet which opens into said bowl; a cap for opening and closing said outlet; and a catch having a handle disposed outside said container and operable upon drawing said handle away from said container to cause said cap to open with resulting discharge of any contents within said reservoir into said enclosure, wherein said outlet is defined by a brim, said container further including a lever which pivots about said brim and which is operatively connected to said cap, said catch causing said lever to pivot with resulting opening and closing of said outlet.

2. The container of claim 1 wherein said catch is pivotally connected to said lever.

3. A container for a number of portions of food comprising: a bowl having an upwardly facing opening; a lid removably attached to said bowl for covering said opening, said bowl and said lid together defining a hollow enclosure; a reservoir associated with said lid and projecting into said enclosure, said reservoir having an outlet which opens into said bowl; a cap for opening and closing said outlet; and a catch having a handle disposed outside said container and operable upon drawing said handle away from said container to cause said cap to open with resulting discharge of any contents within said reservoir into said enclosure, wherein said reservoir has a downwardly extending cylindrical interior wall which terminates at said outlet, said outlet having a diameter substantially the same as that of said interior wall.

4. A container for a number of portions of food comprising: a bowl having an upwardly facing opening; a lid removably attached to said bowl for covering said opening, said bowl and said lid together defining a hollow enclosure; a reservoir associated with said lid and projecting into said enclosure, said reservoir having an outlet which opens into said bowl; a cap for opening and closing said outlet; and a catch having a handle disposed outside said container and operable upon drawing said handle away from said container to cause said cap to open with resulting discharge of any contents within said reservoir into said enclosure, wherein said cap has a pocket in which air is confined as said cap is closed.

5. A container for a number of portions of food comprising: a bowl having an upwardly facing opening; a lid removably attached to said bowl for covering said opening, said bowl and said lid together defining a hollow enclosure; a reservoir associated with said lid and projecting into said enclosure, said reservoir having an outlet which opens into said bowl; a cap for opening and closing said outlet; and a catch having a handle disposed outside said container and operable upon drawing said handle away from said container to cause said cap to open with resulting discharge of any contents within said reservoir into said enclosure, wherein said outlet is defined by a brim and wherein said reservoir has a downwardly extending cylindrical interior wall which terminates at said outlet, said outlet having a diameter substantially the same as that of said interior wall, said container further including a lever which pivots about said brim and which is operatively connected to said cap, said catch causing said lever to pivot with resulting opening and closing of said outlet.

6. A container for a number of portions of food comprising: a bowl having an upwardly facing opening; a lid removably attached to said bowl for covering said opening, said bowl and said lid together defining a hollow enclosure; a reservoir associated with said lid and projecting into said enclosure, said reservoir having an outlet which opens into said bowl; a cap for opening and closing said outlet; and a catch having a handle disposed outside said container and operable upon drawing said handle away from said container to cause said cap to open with resulting discharge of any contents within said reservoir into said enclosure, wherein said outlet is defined by a brim and wherein said cap has a pocket in which air is confined as said cap is closed, said container further including a lever which pivots about said brim and which is operatively connected to said cap, said catch causing said lever to pivot with resulting opening and closing of said outlet.

7. A container for a number of portions of food comprising: a bowl having an upwardly facing opening; a lid removably attached to said bowl for covering said opening, said bowl and said lid together defining a hollow enclosure; a reservoir associated with said lid and projecting into said enclosure, said reservoir having an outlet which opens into said bowl; a cap for opening and closing said outlet; and a catch having a handle disposed outside said container and operable upon drawing said handle away from said container to cause said cap to open with resulting discharge of any contents within said reservoir into said enclosure, wherein said reservoir has a downwardly extending cylindrical interior wall which terminates at said outlet, said outlet having a diameter substantially the same as that of said interior wall and wherein said cap has a pocket in which air is confined as said cap is closed.

8. A container for a number of portions of food comprising: a bowl having an upwardly facing opening; a lid removably attached to said bowl for covering said opening, said bowl and lid together defining a hollow enclosure; a reservoir associated with said lid and projecting into said enclosure, said reservoir having a downwardly facing outlet defined by a brim; a cap removably attached to said reservoir, said cap, when closed, covering said outlet and preventing any contents within said reservoir from discharging therefrom; a lever associated with said cap and in contact with said brim, said brim acting as a fulcrum about which said lever pivots; and a catch having a handle disposed outside said enclosure and operable to cause said lever to pivot with resulting opening of said cap and discharge of any contents within said reservoir into said enclosure.

9. The container of claim 8 wherein said outlet is defined by a brim, said container further including a lever operatively connected to said cap, said lever pivoting about said brim, said catch causing said lever to pivot with resulting opening and closing of said outlet.

10. The container of claim 8 wherein said reservoir has a downwardly extending cylindrical interior wall which terminates at said outlet, said outlet having a diameter substantially the same as that of said interior wall.

11. The container of claim 8 wherein said cap has a pocket in which air is confined as said cap is closed.

12. The container of claim 8 wherein said cap, lever and catch are all joined to said lid and separate with said lid as said lid is removed from said bowl.

13. The container of claim 8 wherein said bowl and said lid have a common axis and each has an annular groove formed therein, said grooves being disposed an equal distance from said axis.

* * * * *